US008615961B2

(12) United States Patent
Kronenberg et al.

(10) Patent No.: US 8,615,961 B2
(45) Date of Patent: Dec. 31, 2013

(54) INSERTION CONNECTOR

(76) Inventors: Max Kronenberg, Solingen (DE); Ralf M. Kronenberg, Haan (DE)

( * ) Notice: Subject to any disclaimer, the term of this patent is extended or adjusted under 35 U.S.C. 154(b) by 158 days.

(21) Appl. No.: 13/122,010

(22) PCT Filed: Sep. 30, 2009

(86) PCT No.: PCT/EP2009/062684
§ 371 (c)(1),
(2), (4) Date: May 10, 2011

(87) PCT Pub. No.: WO2010/037777
PCT Pub. Date: Apr. 8, 2010

(65) Prior Publication Data

US 2011/0203198 A1 Aug. 25, 2011

(30) Foreign Application Priority Data

Oct. 2, 2008 (DE) ..... 20 2008 013 046

(51) Int. Cl.
*E04C 2/38* (2006.01)

(52) U.S. Cl.
USPC ..... 52/656.9; 52/656.5; 52/204.61; 52/456; 52/204.595; 403/298; 403/292

(58) Field of Classification Search
USPC ..... 52/204.61, 456, 585.1, 786.13, 656.9, 52/665, 712, 715, 204.71, 204.595; 403/292, 298, 306, 314
See application file for complete search history.

(56) References Cited

U.S. PATENT DOCUMENTS

| | | | | | |
|---|---|---|---|---|---|
| 2,483,560 | A | * | 10/1949 | Peterson | 52/99 |
| 3,214,802 | A | * | 11/1965 | Davis | 403/280 |
| 3,276,797 | A | * | 10/1966 | Humes, Jr. | 52/715 |
| 3,703,304 | A | * | 11/1972 | Losee | 411/462 |
| 4,240,765 | A | * | 12/1980 | Offterdinger | 403/402 |
| 4,296,587 | A | * | 10/1981 | Berdan | 52/786.1 |
| 4,339,903 | A | * | 7/1982 | Menge | 52/657 |
| 4,527,933 | A | * | 7/1985 | Karhumaki et al. | 411/463 |
| 5,127,762 | A | * | 7/1992 | Havlovitz | 403/298 |
| 5,144,780 | A | * | 9/1992 | Gieling et al. | 52/298 |
| 5,209,599 | A | * | 5/1993 | Kronenberg | 403/298 |
| 5,423,156 | A | * | 6/1995 | Nellessen, Jr. | 52/715 |
| 5,560,731 | A | * | 10/1996 | Kronenberg | 403/298 |
| 5,642,957 | A | * | 7/1997 | Lange | 403/297 |
| 6,347,902 | B1 | * | 2/2002 | Loh | 403/298 |
| 6,398,449 | B1 | * | 6/2002 | Loh | 403/280 |
| 6,406,213 | B1 | * | 6/2002 | Dohman et al. | 403/298 |

(Continued)

FOREIGN PATENT DOCUMENTS

| | | | |
|---|---|---|---|
| DE | 297 22 771 | U1 | 4/1999 |
| DE | 202004013686 | U1 | 1/2006 |
| DE | 200 15 913 | U1 | 2/2007 |
| DE | 202006006087 | U1 | 9/2007 |

*Primary Examiner* — William Gilbert
*Assistant Examiner* — Matthew Gitlin
(74) *Attorney, Agent, or Firm* — McGlew and Tuttle, P.C.

(57) ABSTRACT

An insertion connector (1) is provided for hollow profiled elements (17, 18) of spacers or mullions for insulating glass panes. The insertion connector includes lateral walls (3) and at least one central wall (2) having at least one long opening (9) extending along the longitudinal axis 23) of the connector. At least one holding element (7) projects from the central wall (2). The holding element (7) is arranged adjacently to the through-opening (9). The insertion connector (1) can include other holding elements on the lateral walls (3).

26 Claims, 4 Drawing Sheets

(56) References Cited

U.S. PATENT DOCUMENTS

| | | | | |
|---|---|---|---|---|
| 6,431,784 | B1 * | 8/2002 | Kronenberg | 403/297 |
| 6,568,873 | B1 * | 5/2003 | Peterson | 403/305 |
| 6,764,247 | B1 * | 7/2004 | Kronenberg | 403/292 |
| 6,862,859 | B2 * | 3/2005 | Kronenberg | 52/656.9 |
| 6,938,388 | B2 * | 9/2005 | Bayer | 52/656.9 |
| 7,070,356 | B2 * | 7/2006 | Kronenberg et al. | 403/297 |
| 7,618,210 | B2 * | 11/2009 | Wagner et al. | 403/306 |
| 7,628,562 | B2 * | 12/2009 | Annes | 403/329 |
| 8,109,689 | B2 * | 2/2012 | Kronenberg et al. | 403/298 |
| 2002/0102127 | A1 * | 8/2002 | Loh | 403/292 |
| 2007/0206989 | A1 * | 9/2007 | Wagner et al. | 403/297 |

* cited by examiner

INSERTION CONNECTOR

CROSS REFERENCE TO RELATED APPLICATIONS

This application is a United States National Phase application of International Application PCT/EP2009/062684 and claims the benefit of priority under 35 U.S.C. §119 of German Patent Application DE 20 2008 013 046.8 filed Oct. 2, 2008, the entire contents of which are incorporated herein by reference.

FIELD OF THE INVENTION

The present invention pertains to a plug-in connector with spacers or staves for insulating glass panes, wherein said the plug-in connector has at least one middle wall and side walls as well as at least one retaining element.

BACKGROUND OF THE INVENTION

Such plug-in connectors are known from practice. They are used to connect hollow sections of spacers or staves for insulating glass panes and may be designed as angle brackets or straight connectors. The plug-in connector has at least one middle wall and side walls as well as one or more retaining elements, which are arranged in practice at the free edges of the side walls.

It is, furthermore, known for other plug-in connectors that clamps can be pushed from the outside through the hollow sections and the plug-in connector into end plugs of staves arranged opposite each other. Plug-in connectors with large-area openings at the bottom for passing through the clamp are known for this purpose, in which case three narrow webs are present at the ends and in the middle of a straight plug-in connector instead of an area-covering middle wall.

In addition, it is known from other areas that massive bottom parts or middle walls can be equipped with lamellae or spring bosses as retaining elements, which mesh with ribs, rows of perforations or similar elevations at the adjacent inner wall of the hollow section. The bottoms or middle walls of the plug-in connector are arched concavely or have recessed grooves for receiving the spring.

SUMMARY OF THE INVENTION

The object of the present invention is to show a plug-in connector, which can be used universally and which is also suitable for the use of clamps or other fastening elements for external attached parts.

According to the invention, a plug-in connector is provided for hollow sections of spacers or staves for insulating glass panes. The plug-in connector has at least one middle wall and side walls as well as at least one retaining element. The middle wall has at least one elongated passage opening extending along the connector longitudinal axis as well as at least one projecting retaining element.

The plug-in connector has one or more passage openings at least one middle wall, which permit the passage of clamps or other fastening elements. The passage openings are made narrow and have a limited length. They have an elongated shape and may also extend centrally as well as in the longitudinal direction of the connector. This is advantageous for the passage and positioning of clamps or the like. Furthermore, the middle wall can be made rather massive as a result and impart high rigidity to the connector. The plug-in connector being claimed, especially in the form of a straight connector, combines, due to this shape, a high mechanical stability with suitability for an at least extensively unobstructed passage of clamps or other fastening elements.

Due to the fact that a small area is required for the passage opening, it is possible to additionally arrange retaining elements, for example, opened spring bosses, at the middle wall. These may be coordinated with rows of perforations that may be present and positioned correspondingly. Optimized retaining action can be achieved as a result.

The plug-in connector being claimed is especially suitable for so-called warm edge sections of spacers, which may consist in part of plastic or have a very small wall thickness, e.g., in case of stainless steel sections. It is favorable for such connections if the plug-in connector has an essentially Ω-shaped cross section. Optimized adaptation to the shape of the hollow section with absorption of the tolerances of the hollow section as well as an especially good retaining action can be achieved by means of lateral bulges of the bent side walls and formation of spring bridges.

A closely spaced and adjoining arrangement of the one or more retaining elements at the passage opening offers advantages in terms of manufacturing technology, especially for plug-in connectors that are designed as punched and bent parts made of metal. Opening of the passage opening and of the retaining elements, of which there preferably is a plurality which are arranged in pairs and on both sides of the passage opening, can thus be achieved in one punching operation along with the bending out of these retaining elements.

The present invention is represented as an example and schematically in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The present invention pertains to a plug-in connector 1 for hollow sections 17, 18 of spacers or staves for insulating glass panes. The present invention pertains, furthermore, to an arrangement of hollow sections 17, 18 with a plug-in connector 1 and with an additional attached part, which is fixed by means of a clamp 19 passed through the plug-in connector 1 or of another fastening element.

The plug-in connector 1 may be designed optionally as an angle bracket or as a straight connector. A straight connector is shown in the exemplary embodiments shown. The features thereof may also be extrapolated to an angle bracket with a corresponding adaptation.

Figure 7:
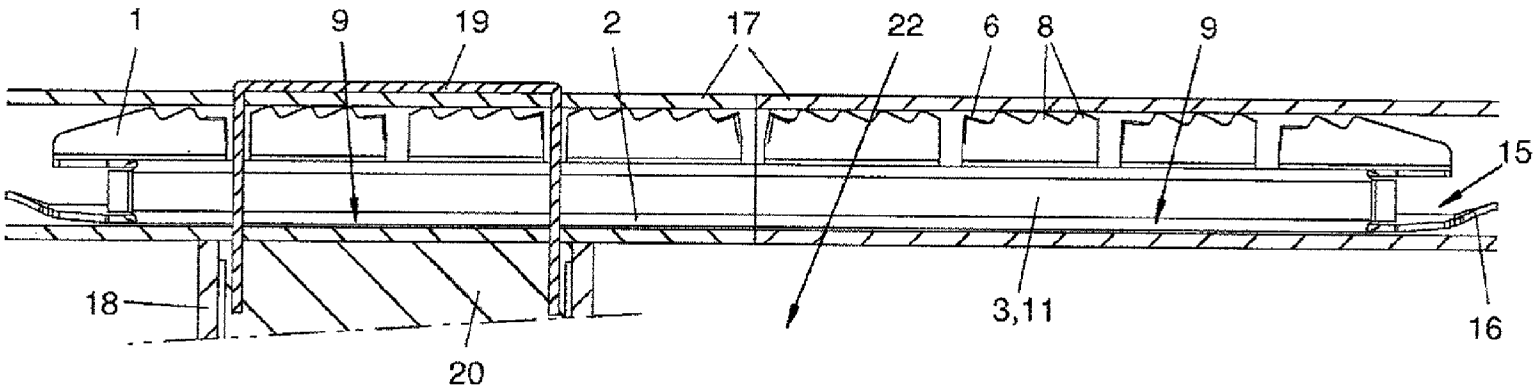
FIG. 7 is a schematic and partly cut-away side view of a plug-in connector in two spacer hollow sections with a clamp shot through along with an end piece attached thereto.

As is illustrated in FIG. 7, the plug-in connector 1 is used, e.g., to connect two hollow sections 17 of a spacer frame for an insulating glass pane. The other parts of the insulating glass pane are not shown for the sake of clarity. The spacer frame with the sections 17 surrounds on the outside an inner, hollow pane interior space 22 in a ring-shaped manner. The aforementioned attached parts, which are designed, e.g., as hollow sections 18, e.g., stave sections, as end plugs 20 or the like and are fixed to the spacer frame and hollow sections 17 thereof in a suitable manner by one or more fastening elements 19, may be located in said pane interior space 22. These fastening elements may be, e.g., essentially U-shaped clamps, which are led from the outside through the hollow section 17 and the plug-in connector 1 into the pane interior space 22 and act there, e.g., on an end piece 20 of a stave section 18 consisting of plastic and fix same. The clamps or fastening elements 19 are shot, e.g., through the hollow section 17 and the plug-in connector 1 with compressed air. The stave section 18 is placed on the end piece 20 in a positive-locking manner and on the outside and is led hereby in the pane interior space 22 and held by means of a flat contact of the end piece 20 fixed on the inside of the hollow section 17.

Figure 3:
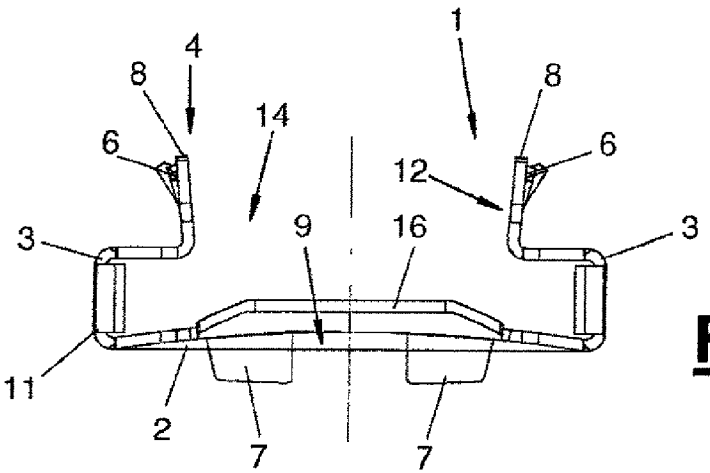
FIG. 3 is the corresponding and enlarged front view of the plug-in connector from FIGS. 1 and 2.
Figure 8:
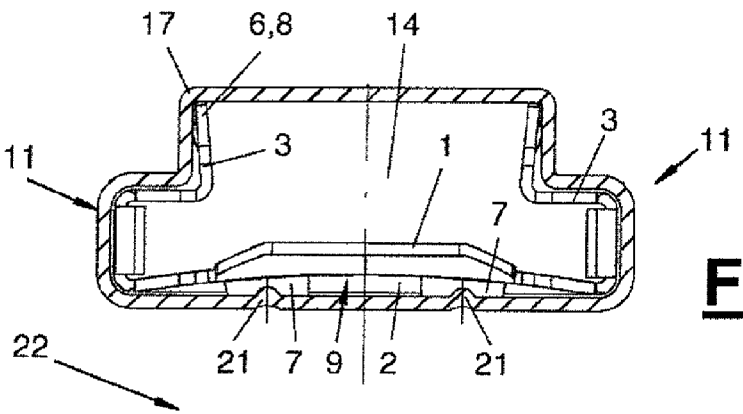
FIG. 8 is a front view of a hollow section with a plug-in connector.

The plug-in connector 1 is designed in a suitable manner for the passage of one or more fastening elements 19. In the preferred embodiment shown, it has an Ω-shaped cross section and has lateral bulges 11. FIGS. 3 and 8 illustrate this design. In addition, it is seen in FIG. 8 that the hollow section 17 has a corresponding hammerhead shape with two lateral bulges 11 at the lower edge or bottom area pointing towards the pane interior space 22. The plug-in connector 1 is adapted to the inner shape of the hollow section 17. If the hollow section 17 is a stave section itself, the cross-sectional shape of the plug-in connector 1 is correspondingly different. In another variant of the preferred embodiments shown, the cross section of the plug-in connector 1 may be essentially U-shaped. It may also have a closed box shape.

The plug-in connector 1 has at least one middle wall 2 and two side walls 3 adjoining on both sides. In addition, it has at least one retaining element 6, 7, 8, which ensures mechanical retention, e.g., by digging into the hollow section 17, which locks it against being pulled out. In the embodiment shown, the plug-in connector 1 has a hollow interior space 14, which is continuously open axially and through which a desiccant not shown present in the hollow section 17 can flow. Obliquely positioned tongues 16, which originate from the middle wall 2, may be located at the open front sides 15.

In the embodiment shown, the plug-in connector 1 is installed in the hollow section 17, e.g., according to FIGS. 7 and 8, such that its middle wall 2 forms a bottom part and points towards the pane interior space 22. The middle wall 2 has at least one elongated and narrow passage opening 9 and at least one projecting retaining element 7.

The passage opening 9 extends along the longitudinal axis 23 of the plug-in connector 1 and is arranged in the inner area of the middle wall 2, preferably centrally. The orientation of the passage opening 9 may be exactly axial or oblique with a predominantly axial direction component. The passage opening 9 has no cover and permits free passage of the fastening element 19.

The retaining element 7 is arranged next to the passage opening 9 and preferably such that it adjoins same. The inner edge of the retaining element 7 forms part of the edge of the passage opening 9. Two retaining elements 7 each are preferably arranged in pairs opposite each other on both sides of the passage opening 9. In the exemplary embodiment being shown, the plug-in connector 1 has a passage opening each extending in the connector longitudinal direction 23 on both sides of a transverse center line 5 with two pairs of retaining elements 7.

The retaining elements 7 are designed as opened spring bosses, which are bent outwardly from the preferably flat middle wall 2 and project downwardly away from the bottom of the connector in the installed position. The middle wall 2 may have, as an alternative, an arch directed towards the interior space 14 and extending over its width.

The retaining elements 7 are arranged in the area of a longitudinally extending perforation 21 of the hollow section 17. FIG. 8 illustrates this position. The obliquely opened spring bosses 7 may have an oblique edge at the free end. They can act on the inwardly projecting perforations 21 in a positive-locking manner. The mutual distance between the retaining elements 7 may deviate from the spacing of the perforations 21, so that a retaining boss 7 will mesh with a perforation projection in a positive-locking and clamping manner with certainty.

The passage opening 9 has a length that is markedly shorter than the length of the leg of the bent or straight plug-in connector 1 from the center line 5 to the adjacent front side 15. The opening length may equal, e.g., approx. two thirds of this leg length. The width of the passage opening 9 is substantially smaller than the width of the middle wall 2. The width of the passage openings 9, which are preferably arranged centrally in the transverse direction, may, in addition, be coordinated with the lateral distance between two rows of perforations 21, on which the retaining elements 7 act. The opening width may be equal to or smaller than this distance between perforations.

Figure 4:
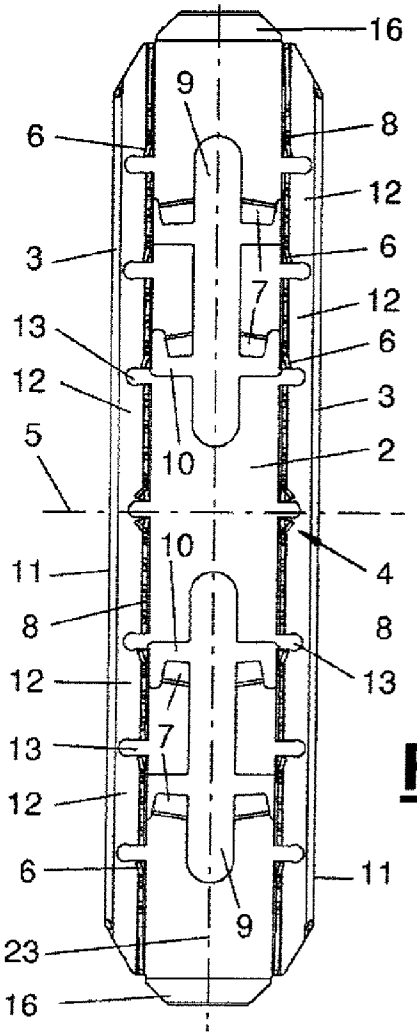
FIG. 4 is a top view of the plug-in connector from FIG. 1.
Figure 5:
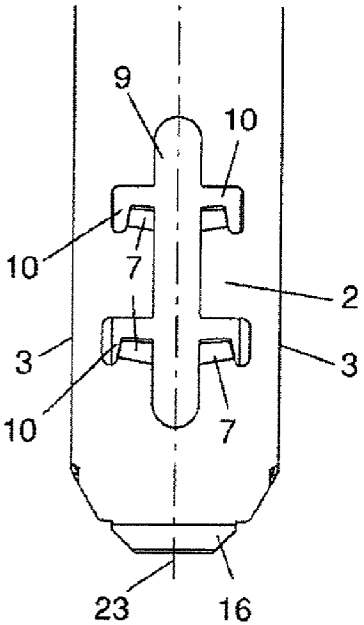
FIG. 5 is a cut-away and enlarged bottom view of a middle wall with passage openings and retaining elements.
Figure 6:
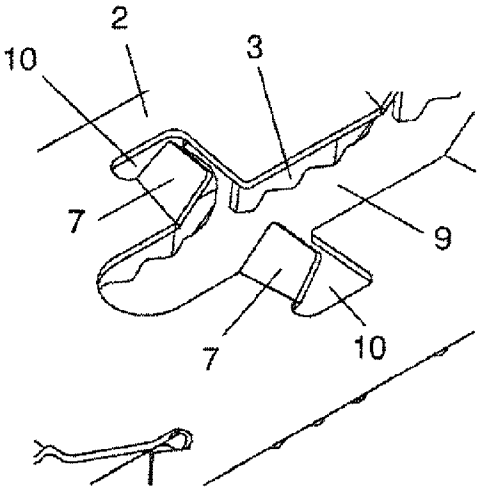
FIG. 6 is a cut-away and enlarged perspective view of the area of the passage opening and of two adjacent retaining elements.

The retaining elements 7 have a projection adjacent opening 10 in the middle wall 2, which is, e.g., L-shaped and opens towards the passage opening 9. The projection adjacent opening 10 is covered by the opened retaining element 7 at least partly. The passage opening 9 and projection adjacent openings 10 adjoining same on both sides may pass over into each other. The width of the retaining elements 7 adjoining the opening edges on both sides may be selected to be such that the retaining elements 7 are located in the projection within the area between the free edges of the bent side walls 3. FIG. 4 illustrates this arrangement. The obliquely downwardly or outwardly opened spring bosses point each towards the center line 5 for retention purposes.

The plug-in connector 1 may consist of any desired and suitable material. In the embodiment shown, it consists of metal, especially cold-rolled steel. As an alternative, it may consist of another material. Furthermore, embodiments made of plastic or another material or even composites are possible.

In the embodiment shown, the plug-in connector 1 is designed as a punched and bent part. The passage openings 9 and projection adjacent openings 10 are punched out of the blank in a punching operation, and the spring bosses 7 are subsequently bent off.

The one or two passage openings 9 may be coordinated with the usual dimensions of the clamps or other fastening elements 19. The clamps 19 may be placed in an axial orientation along the longitudinal axis of the connector. They may also be placed obliquely. In addition, the projection adjacent openings 10 may be used for the passage of the clamps 19 or fastening elements. In addition, it may be sufficient if only one leg extends through the passage opening 9 and/or a projection adjacent opening 10 and the other leg passes through the middle wall 2 in the massive area in case of two-armed clamps 19 of the embodiment variant shown.

In the case of the Ω-shaped cross section of the plug-in connector 1, the side walls 3 are bent in a plurality of steps and form above the bulges 11 an upright web area with a free edge, which acts on the roof of the hollow section 17 and may have as a retaining element 8 one or more teeth projecting upwardly in the extension of the wall. These teeth may vary from one another in their height. In addition, they may be oriented obliquely to the left and/or right or mutually set.

In the area of the center line 5 and the connection site of the hollow sections 17, which site is located there, the side walls 3 may have a transversely extending separation 13, which separates said upright web with the free side wall edge and also extends somewhat to the side in the direction of the bulge 11 at the lower end of the web. Such separations 13 may be present as multiple separations along the two legs of the connector at spaced locations. Spring bridges 12 are formed hereby. The side wall areas cut free by the separations 13 may be elastic in height or vertically and laterally. As is illustrated in FIG. 8, the upwardly projecting webs of the side walls 3 may also be directed obliquely outwardly above the bulges 11.

Figure 1:
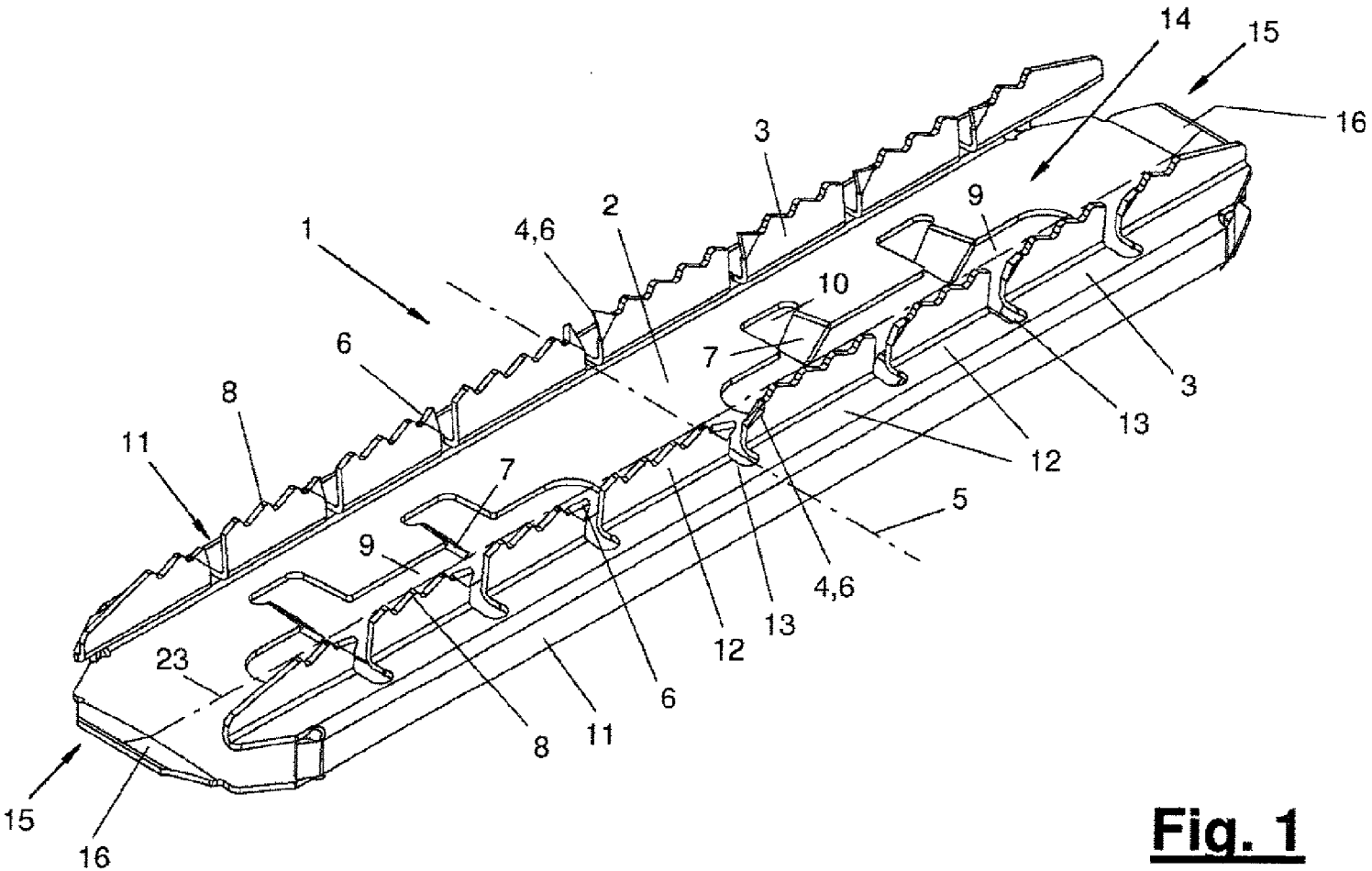
FIG. 1 is a perspective view of a plug-in connector with passage openings and retaining elements at its bottom-side middle wall.
Figure 2:
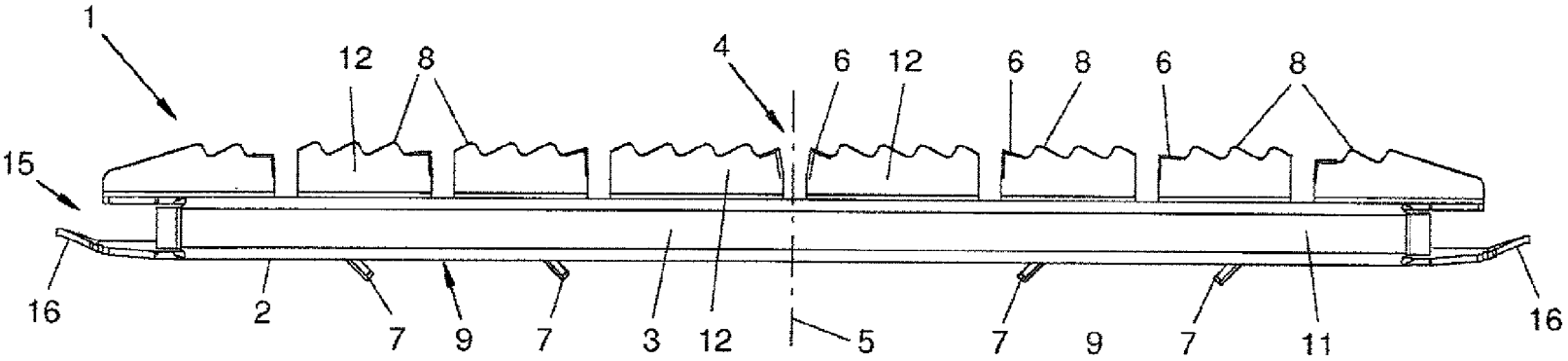
FIG. 2 is a side view of the plug-in connector from FIG. 1.

The spring bridges 12 may have a laterally acting retaining element 6 in the form of an obliquely outwardly opened spring boss at least at one edge area. The spring bosses 6, 8 press against the adjacent inner walls of the hollow section 17 and act, e.g., on the transition between the roof area and side wall as well as on the side wall area of the hollow section 17 located thereunder. FIG. 8 illustrates this embodiment. The spring bosses 6 of the spring bridges 12 may have different height positions according to FIG. 2 and act as a result at different points of the attached hollow section 17, which increases the retaining action.

The plug-in connector 1 may have a middle stop 4. This is formed, e.g., by four obliquely opened spring bosses 6 arranged on both sides of the center line 5. As an alternative, it may be formed by fixed stops, other spring bosses or in any other desired and suitable manner.

Various variants of the embodiments shown and described are possible. This applies, on the one hand, to the cross-sectional shape of the plug-in connector 1 and the shape and arrangement of the retaining elements thereof at the side walls 3 or at another site. Furthermore, the shape and position of the passage openings 9 may vary. This applies to the number, shape and arrangement of the retaining elements 7, which may also be designed in a manner other than as spring bosses. Ribs or other retaining elements 7 may be used, especially in case of a plug-in connector made of plastic. In addition, the retaining elements 7 may be arranged laterally from the passage opening 9 and make do without a clearance 19. This is possible, e.g., in case of plastic connectors or in connectors made of a pourable material, e.g., a metal casting or the like.

While specific embodiments of the invention have been described in detail to illustrate the application of the principles of the invention, it will be understood that the invention may be embodied otherwise without departing from such principles.

The invention claimed is:

1. A plug-in connector for hollow sections of spacers or staves for insulating glass panes, the plug-in connector comprising:

a middle wall;

side walls; and a retaining element, wherein the middle wall has at least one elongated passage opening extending along a connector longitudinal axis, and wherein said retaining element comprises at least one projecting retaining element projecting from said middle wall with a projection adjacent opening, positioned adjacent to said projecting retaining element, in said middle wall, wherein the projection adjacent opening extends towards said passage opening to form a common opening with said passage opening.

2. A plug-in connector in accordance with claim 1, wherein the projecting retaining element is arranged next to the passage opening.

3. A plug-in connector in accordance with claim 1, wherein the projecting retaining element adjoins the passage opening.

4. A plug-in connector in accordance with claim 1, further comprising an additional projecting retaining element wherein projecting retaining elements are arranged on both sides of the passage opening.

5. A plug-in connector in accordance with claim 1, further comprising additional projecting retaining elements to provide bilateral retaining elements wherein the bilateral retaining elements are located opposite each other in pairs.

6. A plug-in connector in accordance with claim 1, further comprising additional projecting retaining elements wherein two pairs of projecting retaining elements are arranged at the passage opening.

7. A plug-in connector in accordance with claim 1, further comprising additional projecting retaining elements wherein the plug-in connector is designed as a straight connector and has at least one passage opening each with projecting retaining elements on both sides of a transversely located center line.

8. A plug-in connector in accordance with claim 1, wherein the retaining element or retaining elements is/are arranged in the area of a longitudinally extending perforation in the hollow section.

9. A plug-in connector in accordance with claim 1, wherein the projection adjacent opening has the shape of an L.

10. A plug-in connector in accordance with claim 1, wherein the projecting retaining element comprises a spring boss bent off outwardly.

11. A plug-in connector in accordance with claim 1, wherein, in a connected state, the middle wall points towards an interior space of an insulating glass pane.

12. A plug-in connector in accordance with claim 1, wherein the middle wall is flat.

13. A plug-in connector in accordance with claim 1, wherein the plug-in connector comprises a punched or bent part from metal.

14. A plug-in connector in accordance with claim 1, wherein the passage opening is intended and designed for passing through a fastening element.

15. A plug-in connector in accordance with claim 1, wherein the passage opening is arranged centrally and has a width that is substantially smaller than a width of the middle wall.

16. A plug-in connector in accordance with claim 8, wherein a width of the passage opening is smaller than or equal to a distance between two rows of perforations.

17. A plug-in connector in accordance with claim 1, further comprising a clamp wherein the clamp fastens an end piece of another hollow section.

18. A plug-in connector in accordance with claim 1, wherein the plug-in connector has a U-shaped, box-shaped or Ω-shaped cross section.

19. A plug-in connector in accordance with claim 1, wherein the plug-in connector has a hollow and axially continuous interior space.

20. A plug-in connector in accordance with claim 1, wherein the plug-in connector has a middle stop.

21. A plug-in connector in accordance with claim 1, wherein the plug-in connector has at least one additional retaining element at at least one side wall.

22. A plug-in connector in accordance with claim 1, further comprising a plurality of retaining elements arranged one after another in the longitudinal direction of the plug-in connector in at least one row and arranged offset in relation to one another in the row such that they act at different points in the hollow section.

23. A plug-in connector in accordance with claim 1, wherein the side walls have lateral bulges and are divided in the longitudinal direction into spring bridges by separations.

24. A plug-in connector in accordance with claim 1, wherein the middle wall has an oblique tongue at the front ends.

25. A plug-in connector for hollow sections of spacers or staves for insulating glass panes, the plug-in connector comprising:

a middle wall comprising a middle wall surface and middle wall projecting retaining elements extending from the middle wall surface, said middle wall surface defining a common opening comprising an elongated passage opening extending along a connector longitudinal axis and projection adjacent openings, respectively positioned adjacent to respective said projecting retaining elements, wherein each projection adjacent opening extends towards said passage opening to form said common opening with said passage opening;

side walls extending from side edges of said middle wall and extending in a longitudinal direction on each side of the longitudinal axis; and a plurality of retaining elements extending from each side wall and arranged one after another in the longitudinal direction of the plug-in connector.

26. A plug-in connector in accordance with claim 25, wherein:

each of said projecting retaining elements has a connected edge connected to a remaining surface of the middle wall; and each projection adjacent opening cooperates with the elongated passage opening such that said common opening is at each end of the connected edge and at a front side of the connected edge.

* * * * *